US008905340B2

(12) United States Patent
Makino et al.

(10) Patent No.: US 8,905,340 B2
(45) Date of Patent: Dec. 9, 2014

(54) PULVERIZER AND CYLINDRICAL ADAPTOR

(75) Inventors: Nobuyasu Makino, Shizuoka (JP); Kazuo Kuratani, Fukui (JP)

(73) Assignee: Ricoh Company, Ltd., Tokyo (JP)

( * ) Notice: Subject to any disclaimer, the term of this patent is extended or adjusted under 35 U.S.C. 154(b) by 398 days.

(21) Appl. No.: 13/368,884

(22) Filed: Feb. 8, 2012

(65) Prior Publication Data

US 2012/0228414 A1 Sep. 13, 2012

(30) Foreign Application Priority Data

Mar. 11, 2011 (JP) ..... 2011-054211

(51) Int. Cl.
*B02C 21/00* (2006.01)
*B02C 19/06* (2006.01)

(52) U.S. Cl.
CPC ..... *B02C 19/065* (2013.01)
USPC ..... 241/39

(58) Field of Classification Search
USPC ..... 241/5, 39
See application file for complete search history.

(56) References Cited

U.S. PATENT DOCUMENTS

| | | | | |
|---|---|---|---|---|
| 6,196,482 | B1 * | 3/2001 | Goto | 241/39 |
| 6,368,765 | B2 | 4/2002 | Izu et al. | |
| 6,503,681 | B2 | 1/2003 | Makino et al. | |
| 7,032,849 | B2 | 4/2006 | Takahashi et al. | |
| 7,156,331 | B2 | 1/2007 | Takahashi et al. | |
| 7,318,990 | B2 | 1/2008 | Makino et al. | |
| 7,364,101 | B2 | 4/2008 | Tanaka et al. | |
| 7,498,114 | B2 | 3/2009 | Makino et al. | |
| 7,753,296 | B2 | 7/2010 | Makino et al. | |
| 7,776,503 | B2 | 8/2010 | Makino et al. | |
| 8,398,007 | B2 * | 3/2013 | Ito et al. | 241/39 |
| 2003/0178514 | A1 | 9/2003 | Makino et al. | |
| 2005/0003294 | A1 | 1/2005 | Murakami et al. | |
| 2007/0031754 | A1 | 2/2007 | Murakami et al. | |
| 2008/0227022 | A1 | 9/2008 | Noge et al. | |
| 2010/0170966 | A1 * | 7/2010 | Makino | 241/5 |

FOREIGN PATENT DOCUMENTS

| | | |
|---|---|---|
| JP | 7-289933 | 11/1995 |
| JP | 8-112543 | 5/1996 |
| JP | 10-174896 | 6/1998 |
| JP | 10-286483 | 10/1998 |
| JP | 11-70340 | 3/1999 |
| JP | 2000-15126 | 1/2000 |
| JP | 2004-73992 | 3/2004 |
| JP | 2004-121958 | 4/2004 |
| JP | 2004-358365 | 12/2004 |
| JP | 2005-144313 | 6/2005 |
| JP | 2006-35106 | 2/2006 |
| JP | 2008-114190 | 5/2008 |
| JP | 2008-259935 | 10/2008 |

* cited by examiner

*Primary Examiner* — Faye Francis
(74) *Attorney, Agent, or Firm* — Oblon, Spivak, McClelland, Maier & Neustadt, L.L.P.

(57) ABSTRACT

A pulverizer, including a spray nozzle to spray airstream; a pulverization chamber to pulverize a subject with the airstream; and a cylindrical adaptor to be fitted to the spray nozzle, including a flow path to pass the airstream sprayed from a front end face of the spray nozzle, including an inlet hole to inhale the subject pulverized in the pulverization chamber into the flow path on a side wall thereof, wherein the front end face of the spray nozzle and a rear end face of the inlet hole are located on the same plane when the cylindrical adaptor is fitted to the spray nozzle.

7 Claims, 6 Drawing Sheets

PRIOR ART

PULVERIZER AND CYLINDRICAL ADAPTOR

CROSS-REFERENCE TO RELATED APPLICATIONS

This patent application is based on and claims priority pursuant to 35 U.S.C. §119 to Japanese Patent Application No. 2011-054211, filed on Mar. 11, 2011, in the Japanese Patent Office, the entire disclosure of which is hereby incorporated herein by reference.

FIELD OF THE INVENTION

The present invention relates to a pulverizer including a spray nozzle spraying airstream and a pulverization chamber in which a subject is pulverized by the airstream. In addition, the present invention relates to a cylindrical adaptor fitted to the spray nozzle.

BACKGROUND OF THE INVENTION

Conventionally, a pulverizer including a spray nozzle spraying airstream and a pulverization chamber (fluid bed) in which a subject is pulverized by the airstream, i.e., a fluidized bed pulverizer is known. The pulverizer includes plural spray nozzles, and the subject collides to each other at a space where the airstreams sprayed from the plural spray nozzles meet each other and is pulverized by the collision energy. The pulverized subject is classified to obtain particles having a desired particle diameter.

Japanese Patent No. 3984120 discloses fitting a cylindrical adaptor to the spray nozzle for the purpose of increasing directivity of the airstream sprayed from the spray nozzle. The cylindrical adaptor includes a flow path the airstream sprayed from a front end face of the spray nozzle passes through. An inlet hole inhaling the pulverized subject in the pulverization chamber into the follow path is located on the side wall thereof.

The cylindrical adaptor inhales the pulverized subject in the pulverization chamber into the follow path through the inlet hole due to an ejector effect of the airstream flowing through the flow path. The pulverized subject inhaled into the flow path is accelerated by the airstreams flowing through the flow path and sprayed from an exit of the cylindrical adaptor to the space where the airstreams meet each other.

The cylindrical adaptor increases directivity of the airstream sprayed from the front end face of the spray nozzle and a subject to be pulverized has high density at the space where the plural airstreams meet each other. Therefore, the pulverization efficiency is improved.

FIG. 9 is a schematic view illustrating conventional spray nozzle and cylindrical adaptor. As FIG. 9 shows, a front end face 114 of the spray nozzle 110 has a tapered surface 112 facing forward. In addition, when a cylindrical adaptor 120 is fitted to the spray nozzle 110, a rear end face 124 of an inlet hole 122 is located behind the front end face 114 of the spray nozzle 110.

However, the ejector effect is not sufficiently obtained when the rear end face 124 of the inlet hole 122 is located behind the front end face 114 of the spray nozzle 110.

Therefore, there is a space where the pulverized subject is inhaled at low speed near the tapered surface 112 of the spray nozzle 110. Consequently, the flow of the pulverized subject stagnates and acceleration efficiency thereof is low, resulting in low pulverization efficiency.

Because of these reasons, a need exists for a pulverizer and a cylindrical adaptor having good pulverization efficiency.

SUMMARY OF THE INVENTION

Accordingly, an object of the present invention is to provide a pulverizer having good pulverization efficiency.

Another object of the present invention is to provide a cylindrical adaptor having good pulverization efficiency.

These objects and other objects of the present invention, either individually or collectively, have been satisfied by the discovery of a pulverizer, comprising:

a spray nozzle configured to spray airstream;

a pulverization chamber configured to pulverize a subject with the airstream; and a cylindrical adaptor configured to be fitted to the spray nozzle, comprising:

a flow path configured to pass the airstream sprayed from a front end face of the spray nozzle, comprising an inlet hole configured to inhale the subject pulverized in the pulverization chamber into the flow path on a side wall thereof, wherein the front end face of the spray nozzle and a rear end face of the inlet hole are located on the same plane when the cylindrical adaptor is fitted to the spray nozzle.

These and other objects, features and advantages of the present invention will become apparent upon consideration of the following description of the preferred embodiments of the present invention taken in conjunction with the accompanying drawings.

DETAILED DESCRIPTION OF THE INVENTION

The present invention provides a pulverizer having good pulverization efficiency.

More particularly, the present invention relates to a pulverizer, comprising:

a spray nozzle configured to spray airstream;

a pulverization chamber configured to pulverize a subject with the airstream; and a cylindrical adaptor configured to be fitted to the spray nozzle, comprising:

a flow path configured to pass the airstream sprayed from a front end face of the spray nozzle, comprising an inlet hole configured to inhale the subject pulverized in the pulverization chamber into the flow path on a side wall thereof, wherein the front end face of the spray nozzle and a rear end face of the inlet hole are located on the same plane when the cylindrical adaptor is fitted to the spray nozzle.

In the present invention, "front" means a downstream side of the airstream along a central axis and an extended line thereof and "rear" means an upstream side of the airstream.

Figure 1:
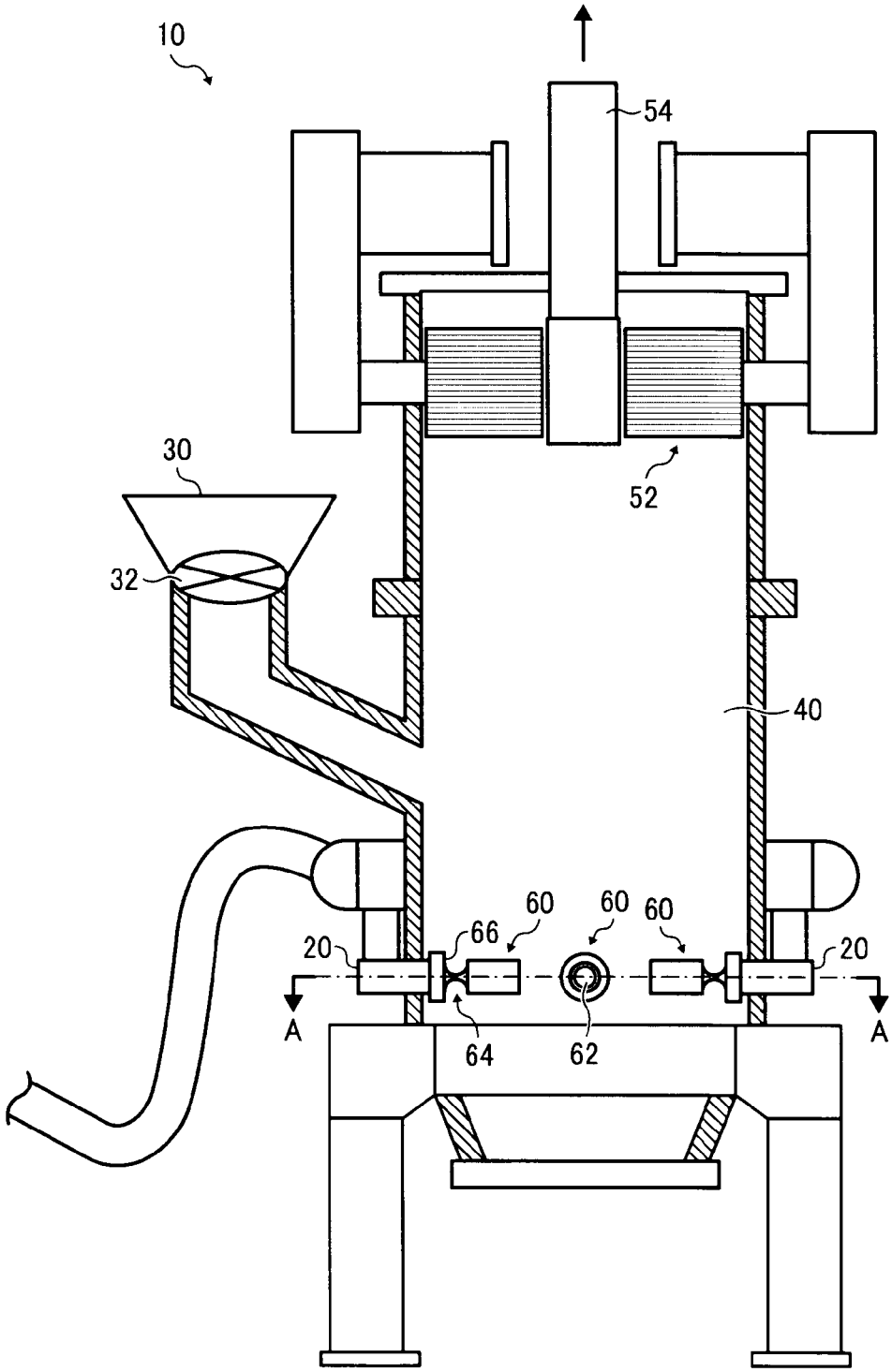
FIG. 1 is a longitudinal sectional view illustrating an embodiment of the pulverizer of the present invention.
Figure 2:
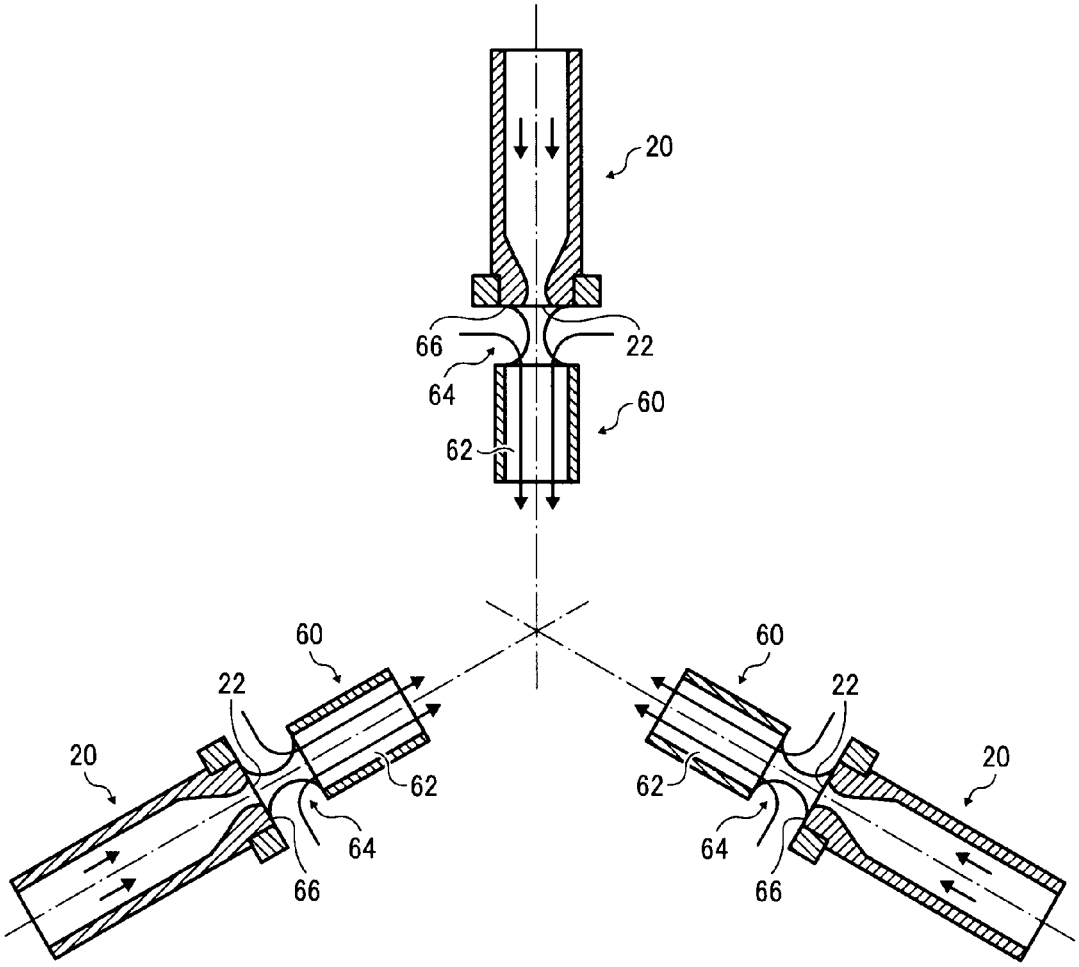
FIG. 2 is a transverse sectional view along A-A line in FIG. 1.

FIG. 1 is a longitudinal sectional view illustrating an embodiment of the pulverizer of the present invention. FIG. 2 is a transverse sectional view along A-A line in FIG. 1.

A pulverizer 10 is a fluidized-bed pulverizer, and, as FIG. 1 shows, includes a spray nozzle 20 spraying airstream, a tank 30 containing a subject to be pulverized, and a pulverization chamber 40 pulverizing the subject fed from the tank 30 with the airstream sprayed from the spray nozzle 20.

The spray nozzle 20 sprays, e.g., an ultrasonic jet stream as the airstream. The airstream is formed of gases such as air and moisture. A pressure of a compressed gas such as compressed air fed to the spray nozzle 20 is not particularly limited, but preferably from 0.2 to 1.0 MPa.

The pulverizer includes plural spray nozzles 20, and the subject collides to each other at a space where the airstreams sprayed from the plural spray nozzles 20 meet each other and is pulverized by the collision energy.

The spray nozzles 20 have extended lines of their central axes located so as to intersect at one point for the purpose of increasing density of the subject to be pulverized, as FIG. 2 shows. Further, the spray nozzles 20 are located at regular intervals (120° intervals in FIG. 2) in a circumferential direction, centering the intersection of the extended lines of the central axes for the purpose of uniforming the density distribution of the subject to be pulverized at the space where the airstreams meet.

A front end face 22 of the spray nozzle 20 is a plane perpendicular to the central axis thereof. Further, the spray nozzle 20 has a regular outer diameter forward near the front end face 22 thereof. Therefore, when a wearable ring 70 mentioned later is fitted to the spray nozzle 20, the front end face 22 thereof and a front end face of the wearable ring 70 are located on the same plane and continuously connected with each other.

The pulverizer may have only one spray nozzle 20, when a collision member is located in front of the spray nozzle. The airstream is sprayed from the spray nozzle to the collision member to crash the subject to the collision member to be pulverized with the collision energy.

The tank 30 contains subjects to be pulverized such as zeolite, silica and resins. They are pulverized to be used, e.g., in a toner.

An on-off valve 32 opening and closing an exit of the tank 30 is located at the exit thereof. The on-off valve 32 is formed of, e.g., an electromagnetic valve. When the on-off valve 32 opens, the subject to be pulverized in the tank 20 is fed into the pulverization chamber 40. When the on-off valve 32 closes, feeding the subject to be pulverized stops. The on-off valve 32 opens and closes such that the subject to be pulverized has a constant amount in the pulverization chamber 40.

The pulverization chamber 40 is a chamber in which the airstream sprayed from the spray nozzle 20 pulverizes the subject to be pulverized fed from the tank 30. The pulverization chamber 40 is formed nearly cylindrical. An intersection where the extended lines of the central axis of the plural spray nozzles 20 is located on a central axis of the pulverization chamber 40.

As FIG. 1 shows, the pulverizer 10 further includes a classier 52 located above the pulverization chamber 40 and a suctioner 54 suctioning a gas and particles in the pulverization chamber 40 into the classifier 52. The classier 52 may have a conventional structure, and formed of, e.g., a rotor. The suctioner 54 may have a conventional structure, and formed of, e.g., a suction fan.

Particles suctioned by the suctioner 54 from the pulverization chamber 40 into the classifier 52 are centrifugally classified into coarse particles and fine particles, and the fine particles having a diameter not greater than a predetermined size are discharged out of the pulverizer 10. Meanwhile, the coarse particles having a diameter not less than a predetermined size are led below the pulverization chamber 40 and pulverized again by the airstream sprayed from the spray nozzles 20.

As FIG. 1 shows, the pulverizer 10 further includes a cylindrical adaptor 60 fitted to the spray nozzle 20 for the purpose of increasing directivity of the airstream sprayed from the spray nozzles 20 and pulverization efficiency of the subject to be pulverized.

Each of the plural spray nozzles 20 has the cylindrical adaptor 60. One cylindrical adaptor 60 is coaxially fitted to one spray nozzle 20. Materials of the cylindrical adaptor 60 are not particularly limited, but are preferably metals such as stainless or ceramics such as alumina in terms of durability.

The cylindrical adaptor 60 include a flow path 62 the airstream sprayed from the front end of the spray nozzle 20 passes through. An inlet hole 64 inhaling the pulverized subject in the pulverization chamber 40 into the flow path 62 is located on a side wall thereof.

The cylindrical adaptor 60 inhales the pulverized subject in the pulverization chamber 40 into the follow path 62 through the inlet hole 64 due to an ejector effect of the airstream flowing through the flow path 62. The pulverized subject inhaled into the flow path 62 is accelerated by the airstreams flowing through the flow path 62 and sprayed from an exit of the cylindrical adaptor 60 to the space where the airstreams meet each other.

The cylindrical adaptor 60 optimizes an accelerating path of the pulverized subject and improves an accelerated amount thereof. Further, the airstream has high directivity and the subject to be pulverized has high density at the space where the airstreams meet each other. These improve pulverization efficiency.

Figure 3:
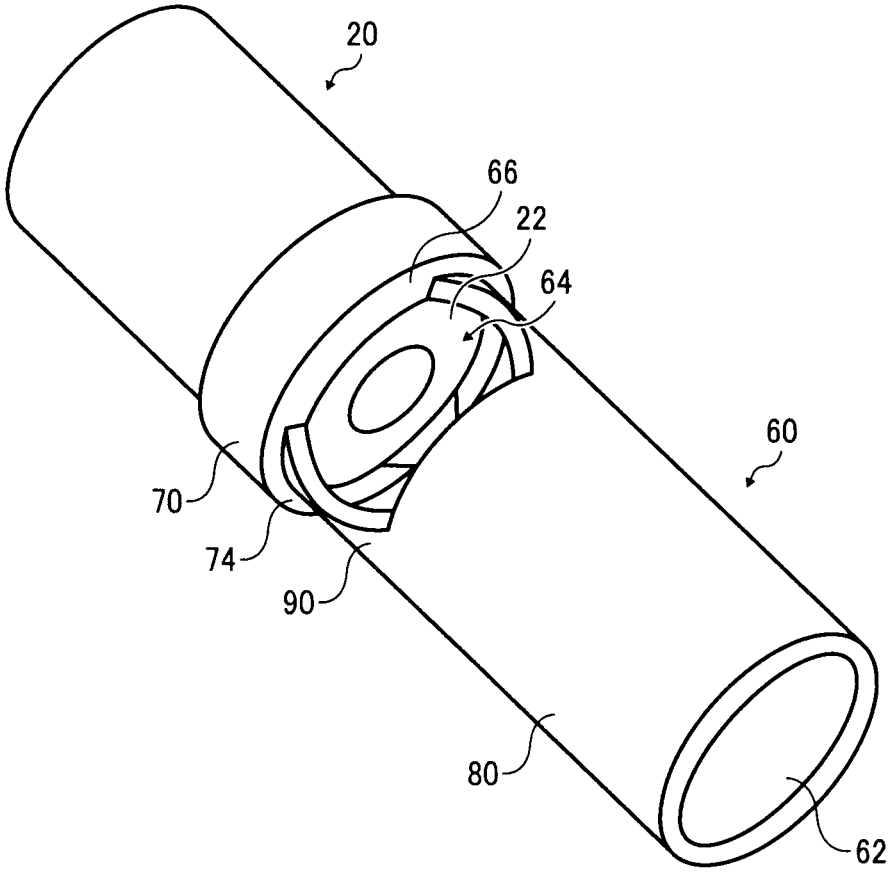
FIG. 3 is a perspective view illustrating an embodiment of the spray nozzle and the cylindrical adaptor.
Figure 4:
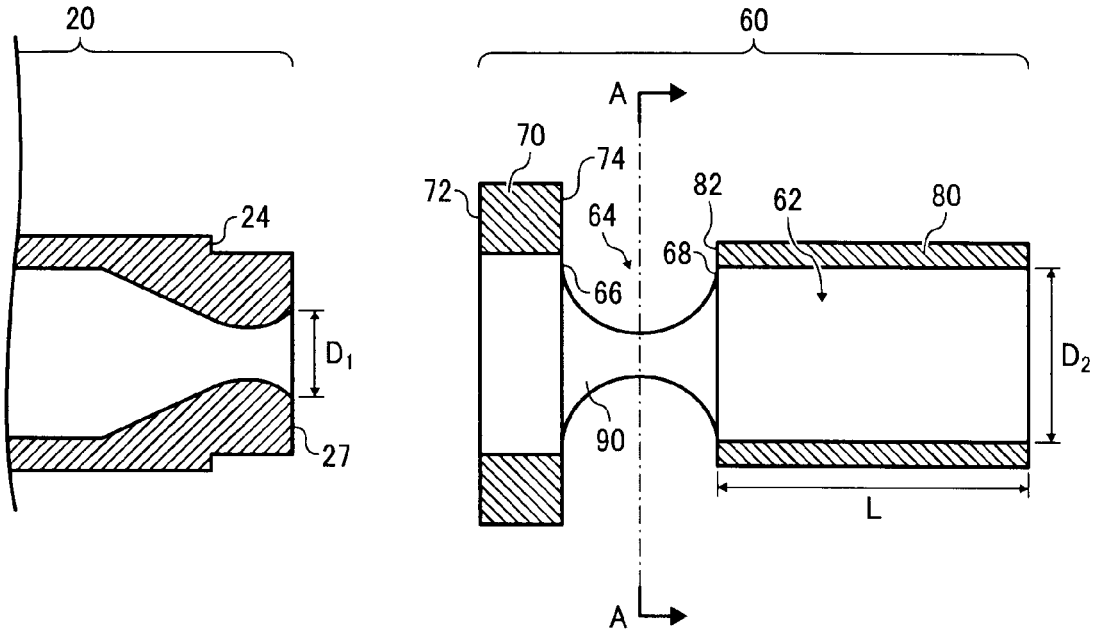
FIG. 4 is a vertical sectional view (1) illustrating the embodiment in FIG. 3.
Figure 5:
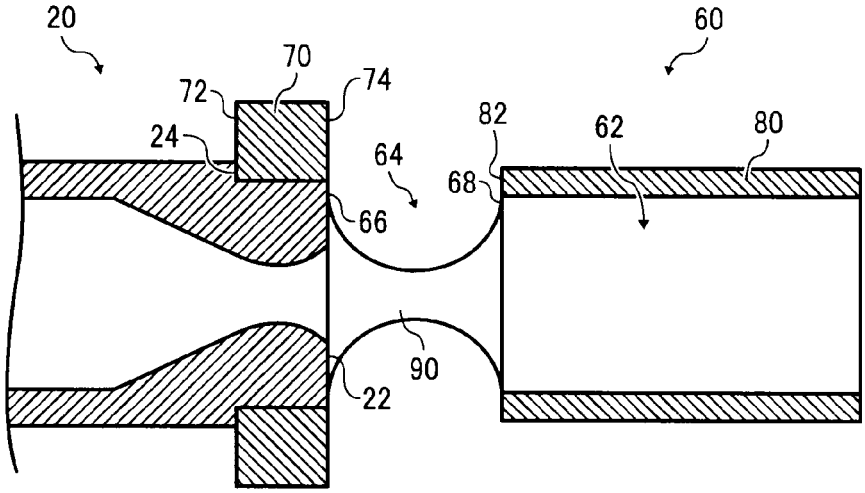
FIG. 5 is another vertical sectional view (2) illustrating the embodiment in FIG. 3.
Figure 6:
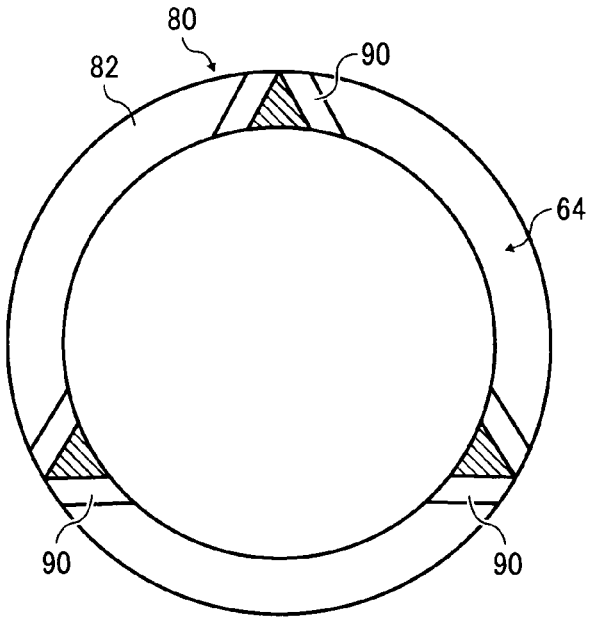
FIG. 6 is a transverse sectional view along A-A line in FIG. 4.
Figure 7:
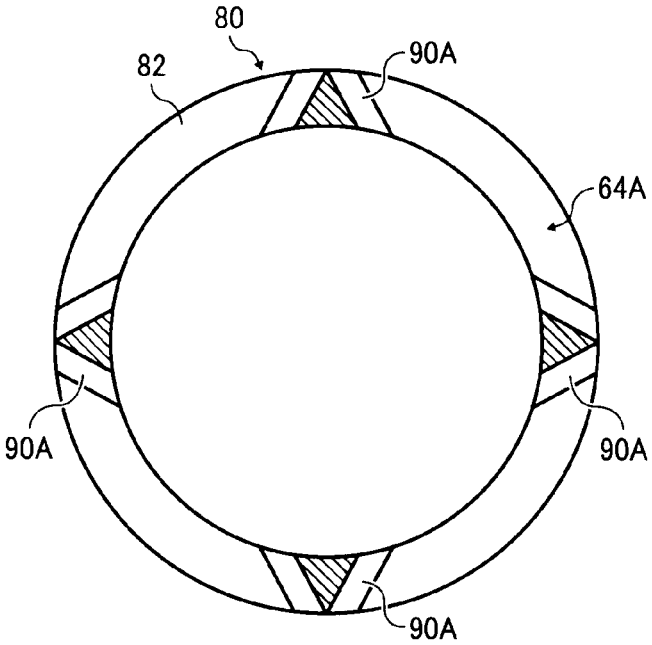
FIG. 7 is a transverse sectional view lustrating a modified embodiment of FIG. 6.
Figure 8:
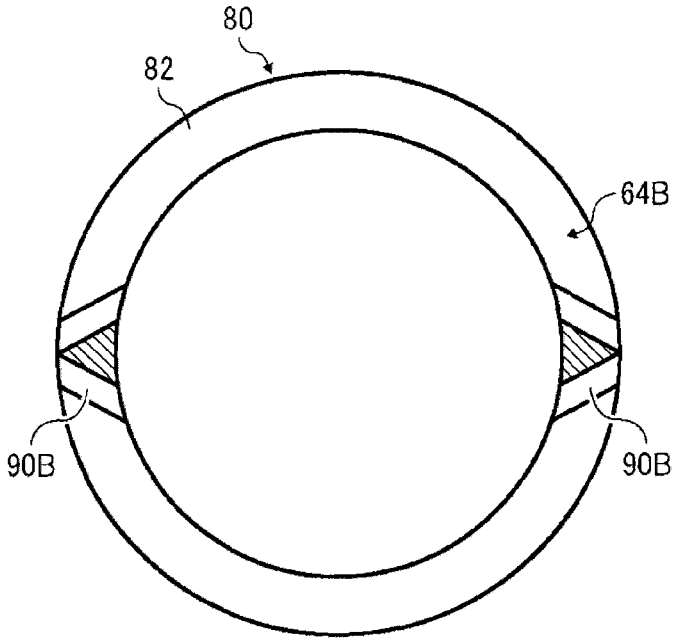
FIG. 8 is a transverse sectional view lustrating another modified embodiment of FIG. 6.

FIG. 3 is a perspective view illustrating an embodiment of the spray nozzle and the cylindrical adaptor. Each of FIGS. 4 and 5 is a vertical sectional view illustrating the embodiment in FIG. 3. The cylindrical adaptor is fitted to the spray nozzle in FIGS. 3 and 5, and the cylindrical adaptor is separated therefrom in FIG. 4. FIG. 6 is a transverse sectional view along A-A line in FIG. 4, and each of FIGS. 7 and 8 is a transverse sectional view lustrating a modified embodiment of FIG. 6.

As FIGS. 3 to 5 show, the cylindrical adaptor 60 includes, e.g., a fitting ring 70 fitting the cylindrical adaptor 60 to the spray nozzle 20, a ring nozzle 80 surrounding a part (mostly a downstream part) of the flow path 62, and a connection member 90 connecting the fitting ring 70 with the ring nozzle 80. The inlet hole 64 is located between the fitting ring 70 and the ring nozzle 80. A rear end face 66 of the inlet hole 64 is formed of a front end face 74 of the fitting ring 70, and a front end face 68 of the inlet hole 64 is formed of a rear end face 82 of the ring nozzle 80.

The cylindrical adaptor 60 includes the fitting ring 70, the ring nozzle 80 and the connection member 90 in a body, and is formed by, e.g., cutting the inlet hole 64 from a cylindrical material. As FIG. 3 shows, the inlet hole 64 has nearly the shape of a circular cylinder divided by the connection member 90 in a circumferential direction.

The fitting ring 70 fits the cylindrical adaptor 60 to the spray nozzle 20, and is fitted on an outer circumference of the spray nozzle 20.

The fitting ring 70 is formed nearly cylindrical and has a constant inner diameter from entrance to exit. The fitting ring 70 includes a groove on its inner circumference, which is engageable with a thread formed on an outer circumference of the spray nozzle 20.

When the fitting ring 70 is fitted to the spray nozzle 20, a rear end face 72 of the fitting ring 70 contacts a step 24 formed on the outer circumference of the spray nozzle 20. This improves positioning preciseness when the fitting ring 70 is fitted to the spray nozzle 20.

When the fitting ring 70 is fitted to the spray nozzle 20, the front end face 74 of the fitting ring 70 and the front end face 22 of the spray nozzle 20 are located on the same plane and continuously connected with each other. The front end face 74 of the fitting ring 70, as mentioned above, forms the rear end face 66 of the inlet hole 64, and therefore the rear end face 66 of the inlet hole 64 and the front end face 22 of the spray nozzle 20 are located on the same plane.

The ring nozzle 80 is located ahead of and apart from the fitting ring 70, and coaxially located therewith. The ring nozzle 80 is formed nearly cylindrical and has a constant inner diameter from entrance to exit.

The ring nozzle 80 surrounds a part (mostly a downstream part) of the flow path 62 the airstream sprayed from the spray nozzle 20 passes through. The nozzle 80 optimizes an accelerating path of the pulverized subject inhaled into an upstream part of the flow path 62 from the pulverization chamber 40 through the inlet hole 64.

The connection member 90 connects the fitting ring 70 with the ring nozzle 80. The connection member 90 has the shape of a rod, and one end thereof is connected with the fitting ring 70 and the other end thereof is connected with the ring nozzle 80.

As FIGS. 6 to 8 show, plural connection members 90 are formed at regular intervals (angles) along a circumference of the cylindrical adaptor 60 so as to uniform a density distribution of the pulverized subject inhaled into an upstream part of the flow path 62 from the pulverization chamber 40 through the inlet hole 64 (In FIGS. 1, 2, 4 and 5, only one is shown). The number of the connection member 90 is not limited, and may be, e.g., 2 to 4.

The number of the connection member 90 equals to that of the inlet hole 64. In FIG. 6, the number of the connection member 90 is 3 and that of the inlet hole 64 is 3. In FIG. 7, the number of the connection member 90A is 4 and that of the inlet hole 64A is 4. In FIG. 8, the number of the connection member 90B is 2 and that of the inlet hole 64B is 2.

The number of the connection member 90 has a tapered transverse section facing outward in a radial direction of the cylindrical adaptor 60. Therefore, the pulverized subject in the pulverization chamber 40 can be inhaled to the upstream part of the flow path 62 while accelerated.

In the present invention, when the cylindrical adaptor 60 is fitted to the spray nozzle 20, the front end face 22 of the spray nozzle 20 and the rear end face 66 of the inlet hole 64 are located on the same plane. Therefore, stagnation of the flow of the pulverized subject can be prevented and the pulverized subject can efficiently be accelerated, which improves pulverization efficiency. As a result, e.g., a pressure of a compressed gas fed to the spray nozzle 20 can be reduced to 0.6 MPa or less, which has been difficult to achieve.

Further in the present invention, when the cylindrical adaptor 60 is fitted to the spray nozzle 20, the front end face 22 of the spray nozzle 20 and the rear end face 66 of the inlet hole 64 are located on the same plane and continuously connected with each other with almost no gaps. Therefore, the stagnation of the flow of the pulverized subject can further be prevented and the pulverized subject and the pulverization efficiency can further be improved.

Further in the present invention, the spray nozzle 20 and the cylindrical adaptor 60 are formed engageable with each other, and a jig for fitting the cylindrical adaptor 60 to spray nozzle 20 is unnecessary and operations of fitting the cylindrical adaptor 60 to the spray nozzle 20 and removing the cylindrical adaptor 60 therefrom are easy.

Next, sizes of the cylindrical adaptor 60 are explained.

A length of the ring nozzle 80 in its axial direction is determined according to properties of the subject to be pulverized. The length of the ring nozzle 80 in its axial direction L (FIG. 4) is preferably from $5\times D_1$ to $50\times D_1$, in which $D_1$ is a diameter of an exit of the spray nozzle 20. This optimizes an accelerating distance of the subject to be pulverized and improves probability of mutual collision thereof. Therefore, volume pulverization increases, pulverization capacity can be improved, and fine powders can be reduced. Further, a toner formed with the pulverized subject produces quality images because the pulverized subject has a stable particle diameter.

A diameter of an exit of the ring nozzle 80 is determined according to properties of the subject to be pulverized. The diameter of an exit of the ring nozzle 80 $D_2$ (FIG. 4) is preferably from $2\times D_1$ to $20\times D_1$, in which $D_1$ is a diameter of an exit of the spray nozzle 20. This optimizes an accelerating amount of the subject to be pulverized and improves probability of mutual collision thereof.

A total of opening areas of the inlet holes 64 is determined according to properties such as magnetism and charged amount of the subject to be pulverized, and desired particle diameter thereof. The total of opening areas of the inlet holes 64 $A_1$ is preferably $0.6\times A_2$ to $0.9\times A_2$, in which $A_2$ is an exit area of the ring nozzle 80. The opening area of the inlet holes 64 is an inner circumferential surface of the inlet hole 64 having the shape of nearly a circular cylinder. This improves an inhaled amount and a mutual collision amount of the subject to be pulverized.

Having generally described this invention, further understanding can be obtained by reference to certain specific examples which are provided herein for the purpose of illustration only and are not intended to be limiting.

EXAMPLES

Example 1

A mixture of 75% by weight of a polyester resin, 10% by weight of a styrene-acrylic copolymer resin and 15% by weight of carbon black was melted and kneaded in a roll mill, cooled to be solidified, and crushed by a hammer mill to prepare a toner material.

The toner material was pulverized and classified by the pulverizer in FIGS. 1 to 5 under the following conditions.

Compressed air pressure fed to spray nozzle: 0.55 MPa

Circumferential speed of rotor forming classifier: 40 m/s

Ring nozzle length L: 16×exit diameter of spray nozzle $D_1$

Exit diameter of ring nozzle $D_2$: $8\times D_1$

Total of opening areas of inlet holes $A_1$: 0.7×exit area of ring nozzle $A_2$

The number of connection members: 3 (FIG. 6)

As a result, a toner having a weight-average particle diameter of 6.5 μm, a content of fine particles having a number-average not greater than 4 μm of 48 pop. %, and a content of coarse particles having weight-average particle diameter not less than of 16 μm of 1.0 vol. % was prepared at 14 kg/hr. The particle diameters were measured by Multisizer Coulter Counter from Beckman Coulter, Inc.

Example 2

The procedure for preparation of the toner in Example 1 was repeated except for changing ring nozzle length L to 20×exit diameter of spray nozzle $D_1$.

As a result, a toner having a weight-average particle diameter of 6.5 μm, a content of fine particles having a number-average not greater than 4 μm of 47 pop. %, and a content of coarse particles having weight-average particle diameter not less than of 16 μm of 0.8 vol. % was prepared at 15 kg/hr.

Example 3

The procedure for preparation of the toner in Example 2 was repeated except for changing exit diameter of ring nozzle $D_2$ to $10\times D_1$.

As a result, a toner having a weight-average particle diameter of 6.5 μm, a content of fine particles having a number-average not greater than 4 μm of 47 pop. %, and a content of coarse particles having weight-average particle diameter not less than of 16 μm of 0.8 vol. % was prepared at 16 kg/hr.

Example 4

The procedure for preparation of the toner in Example 3 was repeated except for changing total of opening areas of inlet holes $A_1$ to 0.9×exit area of ring nozzle $A_2$.

As a result, a toner having a weight-average particle diameter of 6.5 μm, a content of fine particles having a number-average not greater than 4 μm of 47 pop. %, and a content of coarse particles having weight-average particle diameter not less than of 16 μm of 0.8 vol. % was prepared at 16.5 kg/hr.

Comparative Example 1

Figure 9:
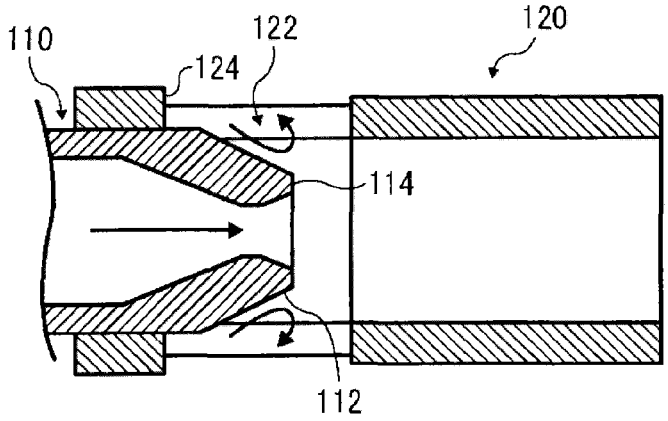
FIG. 9 is a vertical sectional view illustrating conventional spray nozzle and cylindrical adaptor.

The procedure for preparation of the toner in Example 1 was repeated except for replacing the cylindrical adaptor in FIGS. 1 to 6 with a conventional cylindrical adaptor in FIG. 9, changing compressed air pressure fed to spray nozzle to 0.6 MPa and circumferential speed of rotor forming classifier to 45 m/s.

As a result, a toner having a weight-average particle diameter of 6.7 μm, a content of fine particles having a number-average not greater than 4 μm of 48 pop. %, and a content of coarse particles having weight-average particle diameter not less than of 16 μm of 1.0 vol. % was prepared at 13 kg/hr.

Additional modifications and variations of the present invention are possible in light of the above teachings. It is therefore to be understood that within the scope of the appended claims the invention may be practiced other than as specifically described herein.

What is claimed is:

1. A pulverizer, comprising:

a spray nozzle configured to spray airstream;

a pulverization chamber configured to pulverize a subject with the airstream; and a cylindrical adaptor configured to be fitted to the spray nozzle, comprising:

a flow path configured to pass the airstream sprayed from a front end face of the spray nozzle, comprising an inlet hole configured to inhale the subject pulverized in the pulverization chamber into the flow path on a side wall thereof, wherein the front end face of the spray nozzle and a rear end face of the inlet hole are located on the same plane when the cylindrical adaptor is fitted to the spray nozzle.

2. The pulverizer of claim 1, wherein the cylindrical adaptor further comprises:

a fitting ring configured to fit the cylindrical adaptor to the spray nozzle;

a ring nozzle configured to surround a part of the flow path; and a connection member configured to connect the fitting ring with the ring nozzle, wherein the inlet hole is located between the fitting ring and the ring nozzle, and wherein the front end face of the spray nozzle and a front end face of the fitting ring are located on the same plane and continuously connected with each other.

3. The pulverizer of claim 2, wherein the ring nozzle has a length of from $5\times D_1$ to $50\times D_1$ wherein $D_1$ represents a diameter of an exit of the spray nozzle.

4. The pulverizer of claim 2, wherein the ring nozzle has an exit diameter of from $2\times D_1$ to $20\times D_1$ wherein $D_1$ represents a diameter of an exit of the spray nozzle.

5. The pulverizer of claim 1, wherein the inlet hole has a total opening area of from $0.6\times A_2$ to $0.9\times A_2$ wherein $A_2$ is an exit area of the ring nozzle.

6. The pulverizer of claim 2, wherein two or more of the connection members are located at regular intervals along a circumference of the cylindrical adaptor.

7. The pulverizer of claim 1, wherein the spray nozzle and the cylindrical adaptor are engageable with each other.

* * * * *